US007153064B2

(12) United States Patent
Zeilinger et al.

(10) Patent No.: US 7,153,064 B2
(45) Date of Patent: Dec. 26, 2006

(54) PIPE SLEEVE FOR A FLOATING DOCK

(75) Inventors: Brian K. Zeilinger, Janesville, WI (US); Richard R. Popp, Beloit, WI (US)

(73) Assignee: PlayStar, Inc., Janesville, WI (US)

( * ) Notice: Subject to any disclaimer, the term of this patent is extended or adjusted under 35 U.S.C. 154(b) by 0 days.

(21) Appl. No.: 11/066,415

(22) Filed: Feb. 25, 2005

(65) Prior Publication Data

US 2006/0191460 A1 Aug. 31, 2006

(51) Int. Cl.
*B63B 38/00* (2006.01)
*F16L 3/10* (2006.01)

(52) U.S. Cl. ..... 405/221; 114/263; 248/67.5

(58) Field of Classification Search ..... 114/266, 114/267, 263; 405/219, 221; 248/65, 67.5, 248/70, 74.4
See application file for complete search history.

(56) References Cited

U.S. PATENT DOCUMENTS

| | | | | | |
|---|---|---|---|---|---|
| 558,391 | A | * | 4/1896 | Israel | 248/74.4 |
| 2,550,001 | A | | 4/1951 | Button | |
| 3,074,239 | A | | 1/1963 | Mustard | |
| 3,614,871 | A | * | 10/1971 | Nordell | 405/221 |
| 4,004,766 | A | * | 1/1977 | Long | 248/55 |
| 4,028,899 | A | | 6/1977 | Carmichael, III | |
| 4,212,564 | A | | 7/1980 | Kay | |
| 4,352,597 | A | | 10/1982 | Kay | |
| 4,783,030 | A | | 11/1988 | Buerhop | |
| 4,981,397 | A | | 1/1991 | Wiltse | |
| 5,156,493 | A | | 10/1992 | Johnson | |
| 5,281,042 | A | * | 1/1994 | Belrose | 403/234 |
| 5,687,938 | A | | 11/1997 | Bailey | |
| 6,098,564 | A | | 8/2000 | Zeilinger | |
| 6,145,463 | A | | 11/2000 | Zeilinger | |
| 6,746,181 | B1 | | 6/2004 | Heintz et al. | |
| 6,945,735 | B1 | * | 9/2005 | Doverspike | 405/184.4 |

OTHER PUBLICATIONS

Admitted Prior Art Follansbee Dock Systems Pipe Holders with Set Screws (Date Unknown), page 1.
Admitted Prior Art MERCO Marine Pipesleeve (Date Unknown), page 1.
Admitted Prior Art Playstar Pipesleeve, page 1.

* cited by examiner

*Primary Examiner*—Sherman Basinger
(74) *Attorney, Agent, or Firm*—Michael Best & Friedrich LLP

(57) ABSTRACT

A pipe sleeve assembly includes a base plate and a sleeve portion. The base plate includes a base portion defining a longitudinal axis. The base plate further includes a first flange extending from the base portion in a first direction generally normal to the longitudinal axis and lying in a first plane. The base plate also includes a second flange extending from the base portion in the first direction, spaced from the first flange in a second direction generally parallel to the longitudinal axis, and lying in a second plane spaced from the first plane. The sleeve portion includes a body portion and a third flange extending from the body portion in the first direction. A fastener stud extends from the second flange and is received in an aperture in the third flange to secure the sleeve portion to the base plate.

40 Claims, 5 Drawing Sheets

PIPE SLEEVE FOR A FLOATING DOCK

FIELD OF THE INVENTION

The invention relates to pipe sleeves, and more particularly to pipe sleeves used on floating docks.

BACKGROUND OF THE INVENTION

Floating docks are used to moor boats and other water craft, and are advantageous for use where the water level may change because the dock surface will always stay above the water level. Typically the floating dock includes a number of floats coupled to the underside of the dock.

The dock is commonly anchored to the bottom of the waterway using a plurality of posts or pipes that are driven into or otherwise secured to the lake bottom or river bed (e.g., via augers on the bottom of the pipes). The pipes are commonly coupled to the dock using pipe sleeves that form a free-floating fit with the pipe. This enables the dock to rise and fall with the changing water level.

SUMMARY OF THE INVENTION

The present invention provides an improved pipe sleeve arrangement suitable for use on floating docks. Unlike prior art one-piece pipe sleeves that require burdensome manipulation of the long pipes and their auger attachments during installation and removal of the dock, the two-piece construction of the present pipe sleeve allows easier movement and storage of the dock because the pipes can be taken off and secured to the dock very easily. Furthermore, the two-piece pipe sleeve of the present invention does not include any welds, making the manufacture of the pipe sleeve less expensive. In addition, the pipe sleeve of the invention has a low-profile design, and much of the mounting hardware is hidden from view when assembled.

More specifically, the present invention provides a pipe sleeve assembly having a base plate and a sleeve portion. The base plate includes a base portion defining a longitudinal axis and configured for receiving a pipe. The base plate further includes a first flange extending from the base portion in a first direction generally normal to the longitudinal axis and lying in a first plane. The first flange includes an aperture for receiving a first fastener configured to secure the base plate to a mounting surface. The base plate also includes a second flange extending from the base portion in the first direction, spaced from the first flange in a second direction generally parallel to the longitudinal axis, and lying in a second plane spaced from the first plane. The sleeve portion includes a body portion configured for receiving the pipe, and a third flange extending from the body portion in the first direction. The third flange overlies at least a portion of the second flange and includes an aperture. A fastener stud extends from the second flange and is received in the aperture in the third flange to secure the sleeve portion to the base plate.

In one aspect of the invention, the fastener stud is part of a second fastener extending through an aperture in the second flange. The second fastener includes a head having a head height, and the first and second planes are spaced apart by a distance substantially equal to the head height of the second fastener.

In another aspect of the invention, the third flange also overlies at least a portion of the first flange and at least a portion of the first fastener. The first fastener includes a head having a head height, and the third flange is spaced from the first flange by a distance substantially equal to the head height of the first fastener.

The invention also provides a floating dock assembly including a frame, at least one float coupled to the frame, a sleeve assembly coupled to a mounting surface of the frame, and a support member slidably received in the sleeve assembly such that the support member can move relative to the sleeve assembly. The sleeve assembly includes a base plate having a base portion defining a longitudinal axis and receiving the support member. The base plate further includes a first flange extending from the base portion in a first direction generally normal to the longitudinal axis and abutting the mounting surface. The first flange includes an aperture for receiving a first fastener securing the base plate to the mounting surface. The base plate also includes a second flange extending from the base portion in the first direction, spaced from the first flange in a second direction generally parallel to the longitudinal axis, and spaced from the mounting surface. The sleeve assembly further includes a removable sleeve portion having a body portion receiving the support member, and a third flange extending from the body portion in the first direction. The third flange overlies at least a portion of the second flange. A second fastener is coupled with the second and third flanges to secure the sleeve portion to the base plate.

Other features and advantages of the invention will become apparent to those skilled in the art upon review of the following detailed description, claims, and drawings.

Figure 1:
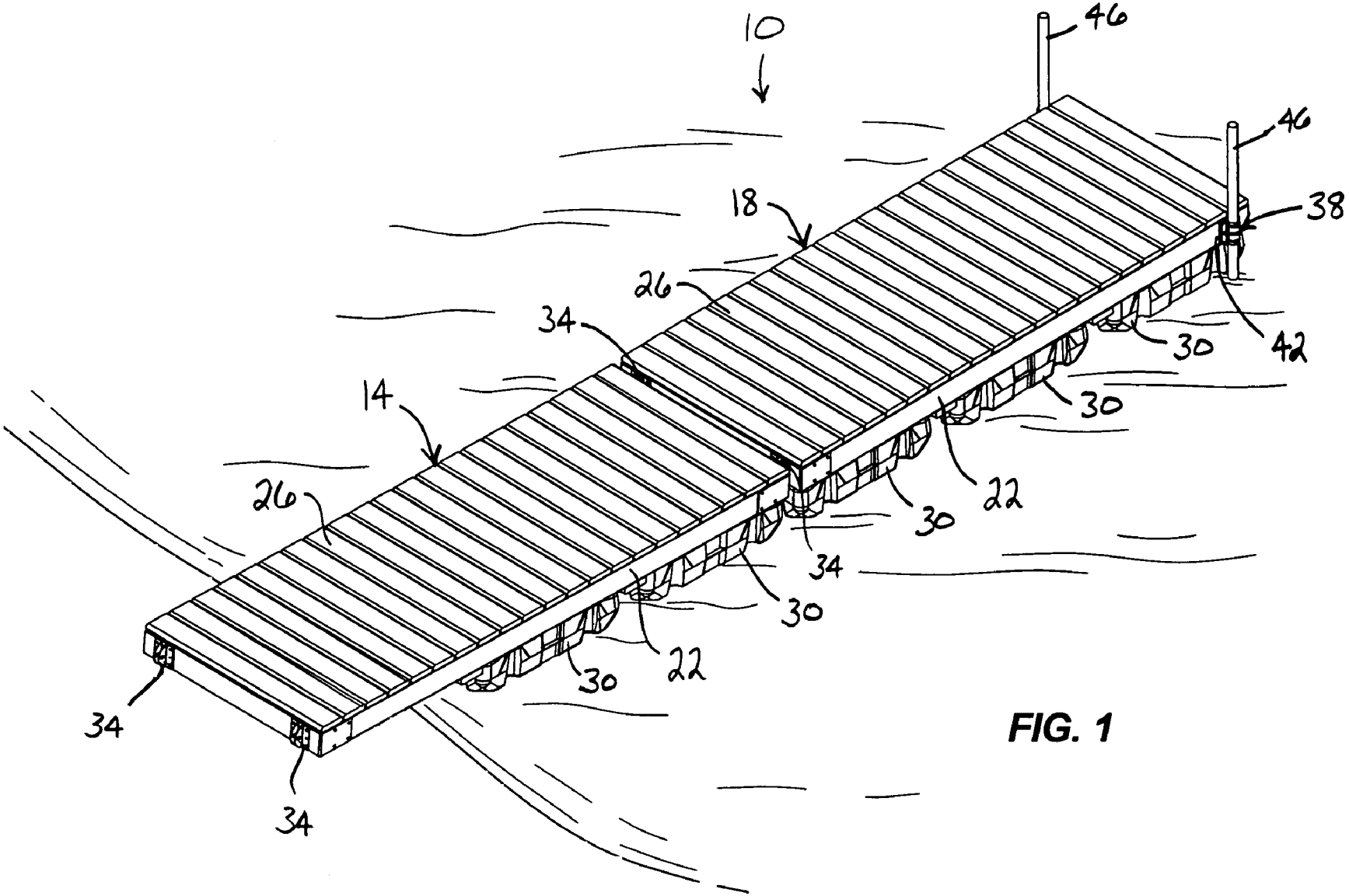
FIG. 1 is a perspective view of a floating dock including a pipe sleeve assembly embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including", "having" and "comprising" and variations thereof herein is meant to encompass the items listed thereafter and equivalents thereof as well as additional items.

DETAILED DESCRIPTION

FIG. 1 illustrates a floating dock 10 embodying the invention. The illustrated floating dock 10 includes first and second dock sections 14 and 18, respectively, but could include fewer or more sections as desired. Additionally, other configurations for the dock 10 could be substituted (e.g., L-shaped configurations, T-shaped configurations, multiple slip configurations, etc.). Each section 14, 18 includes a frame 22 that supports decking 26. Each section 14, 18 also includes one or more floats 30 coupled to the underside of the frame 14 for floatably supporting the frame 22 and decking 26 above the water. The two sections 14, 18 are pivotably coupled together by hinge joints 34 on the frames 22.

Figure 2:
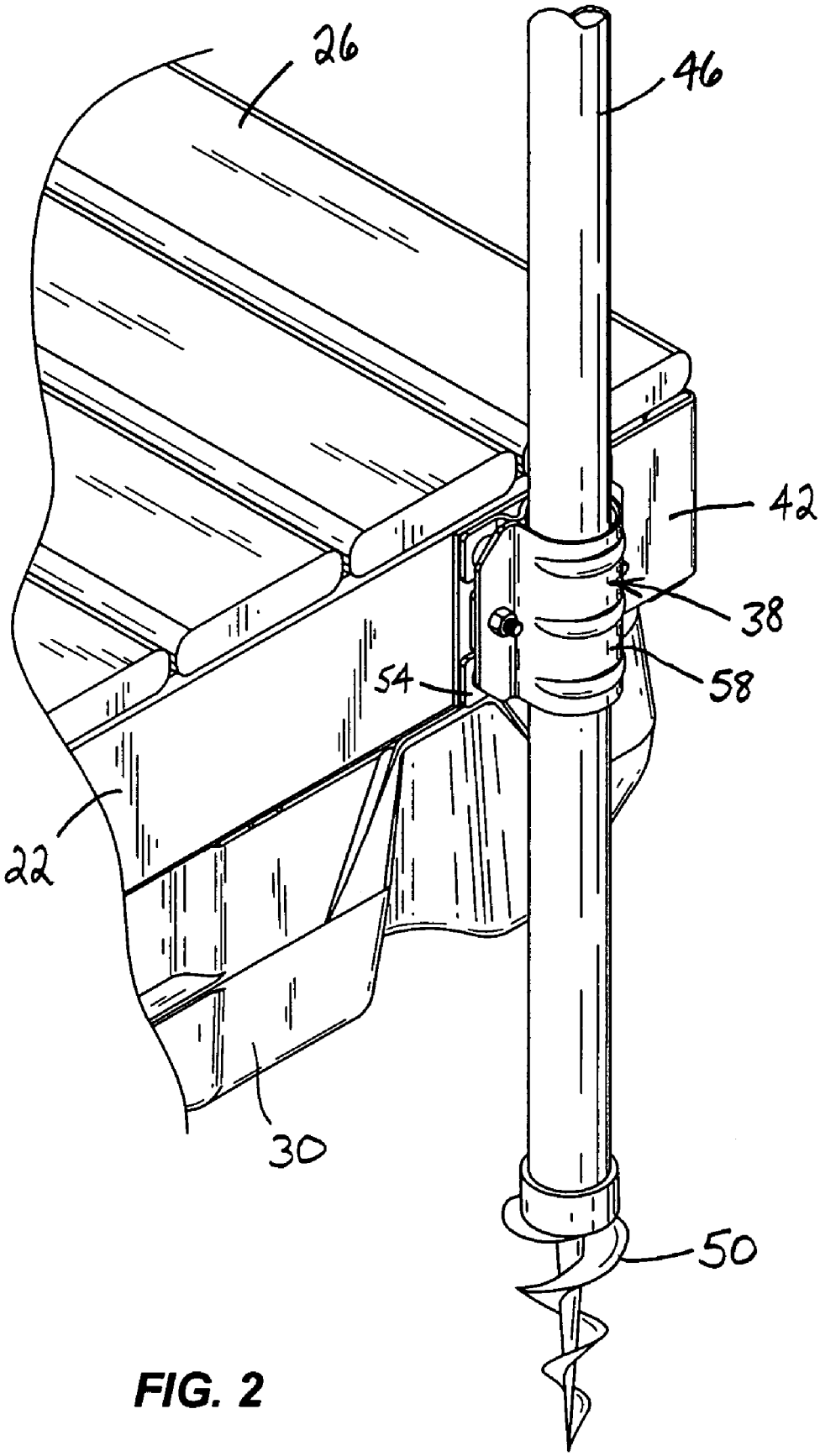
FIG. 2 is an enlarged partial perspective view of the floating dock of FIG. 1.

As seen in FIG. 1, the second section 18 includes two substantially identical pipe sleeve assemblies 38 (only one is shown) coupled to the frame 22 on oppositely-facing mounting surfaces 42 of the frame 22. In the illustrated embodiment, the mounting surfaces 42 are portions of metal plates that are coupled to the frame 22. However, separate plates are not required, and the pipe sleeve assemblies 38 could alternatively be mounted directly to the stringer members forming the frame 22. The pipe sleeve assemblies 38 slidably support and retain respective support members in the form of posts or pipes 46. As used herein and in the appended claims, the term "pipe" is not intended to be limited to only a hollow member having a generally circular cross section. Instead, the term "pipe" can include elongated members of any cross-sectional shape, whether hollow or solid. As shown in FIG. 2, each pipe 46 has coupled thereto an auger portion 50 configured to screw into the river bed or lake bottom, thereby securing the pipes 46 in position.

The pipe sleeve assemblies 38 retain the pipes 46 while providing a free-floating fit that enables the pipe sleeve assemblies 38, and therefore the entire dock section 18, to move vertically relative to the pipes 46 to accommodate variations in the water level. It should be understood that the illustrated pipes 46 and auger portions 50 represent only one way of anchoring a floating dock, and that the pipe sleeve assemblies 38 could be used to slidably retain other support members that may be secured to the river bed or lake bottom in different manners.

Figure 3:
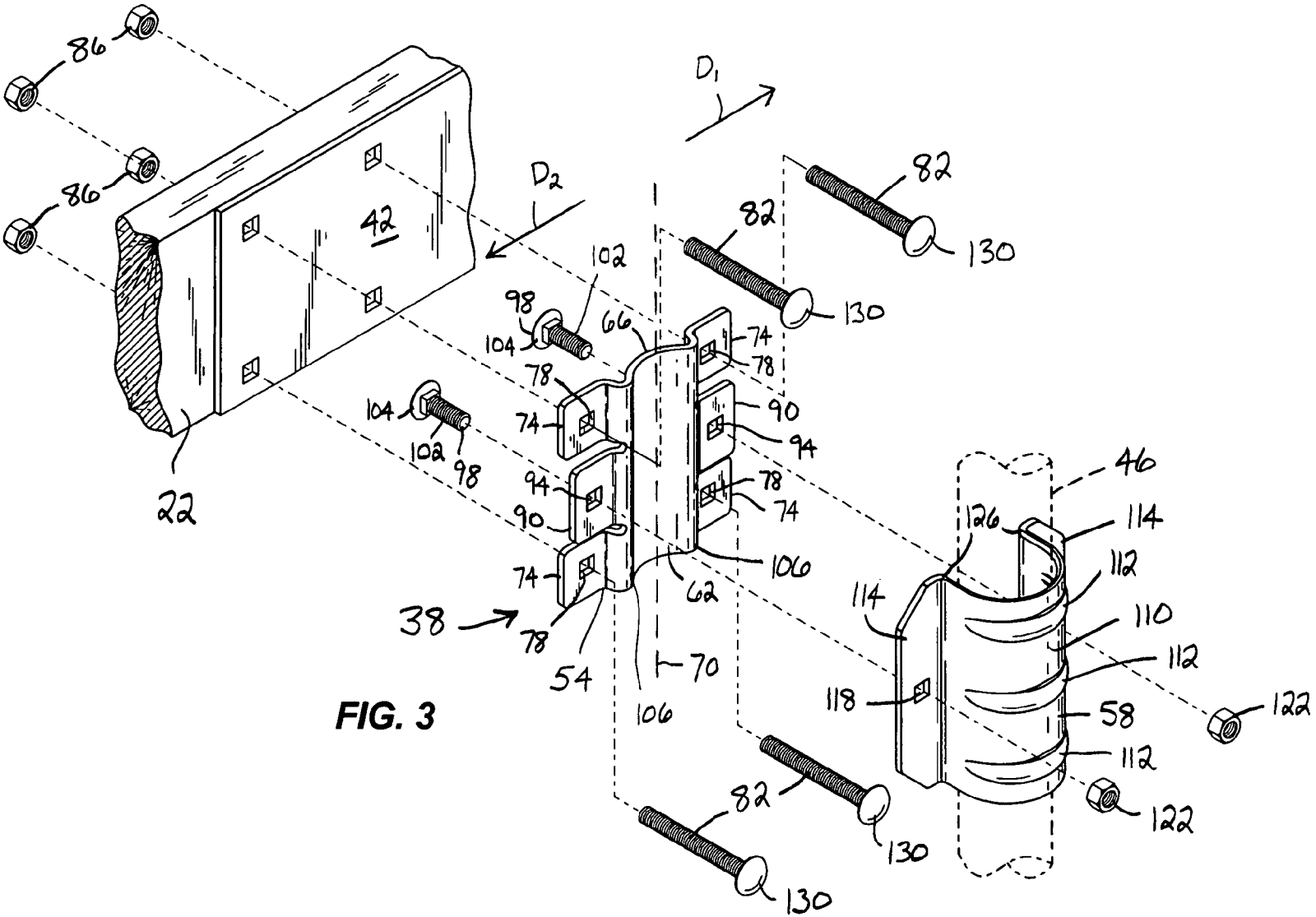
FIG. 3 is exploded perspective view illustrating the pipe sleeve assembly and a portion of the floating dock.
Figure 4:
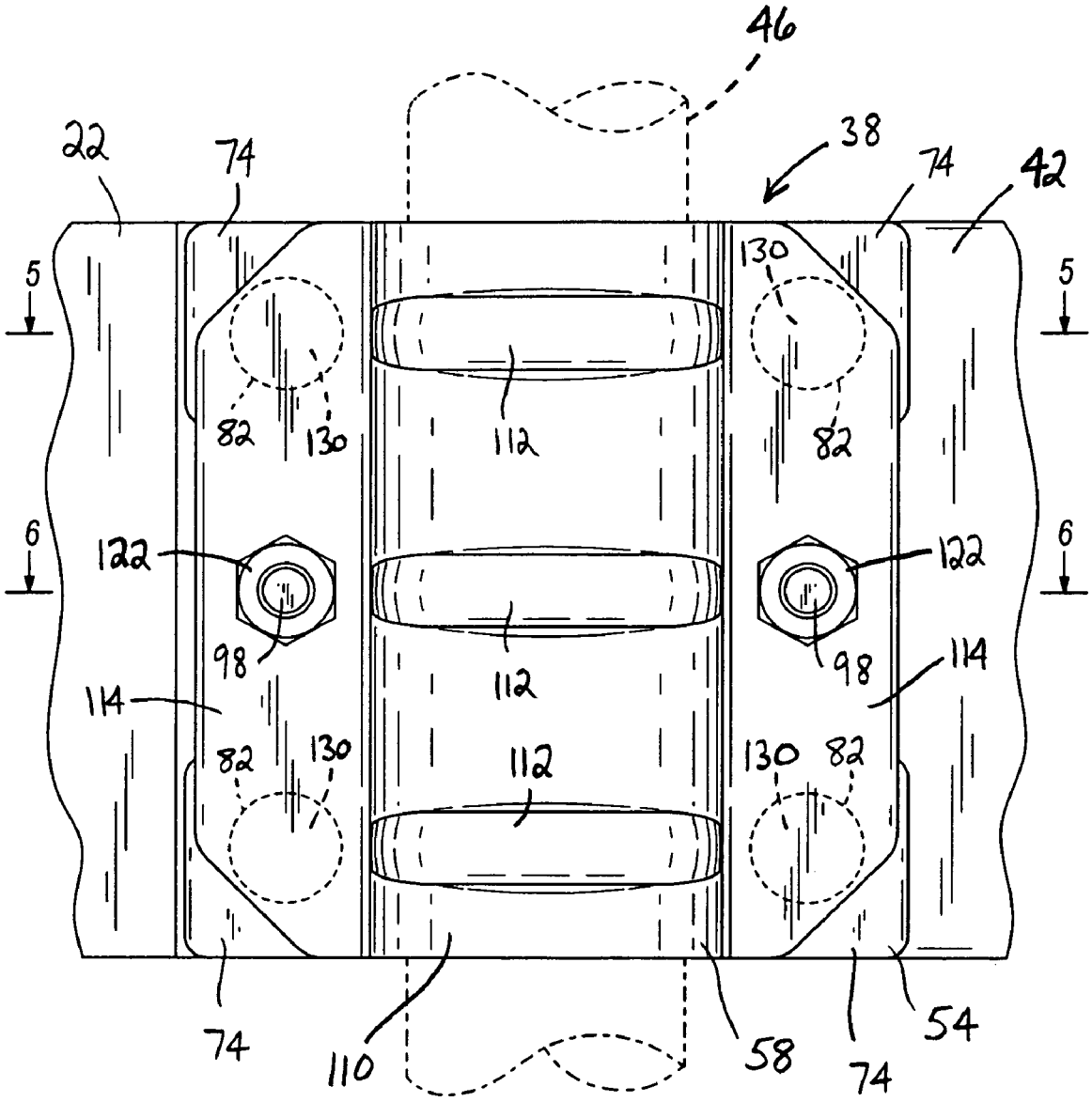
FIG. 4 is an enlarged front view illustrating the pipe sleeve assembly mounted on the floating dock.
Figure 5:
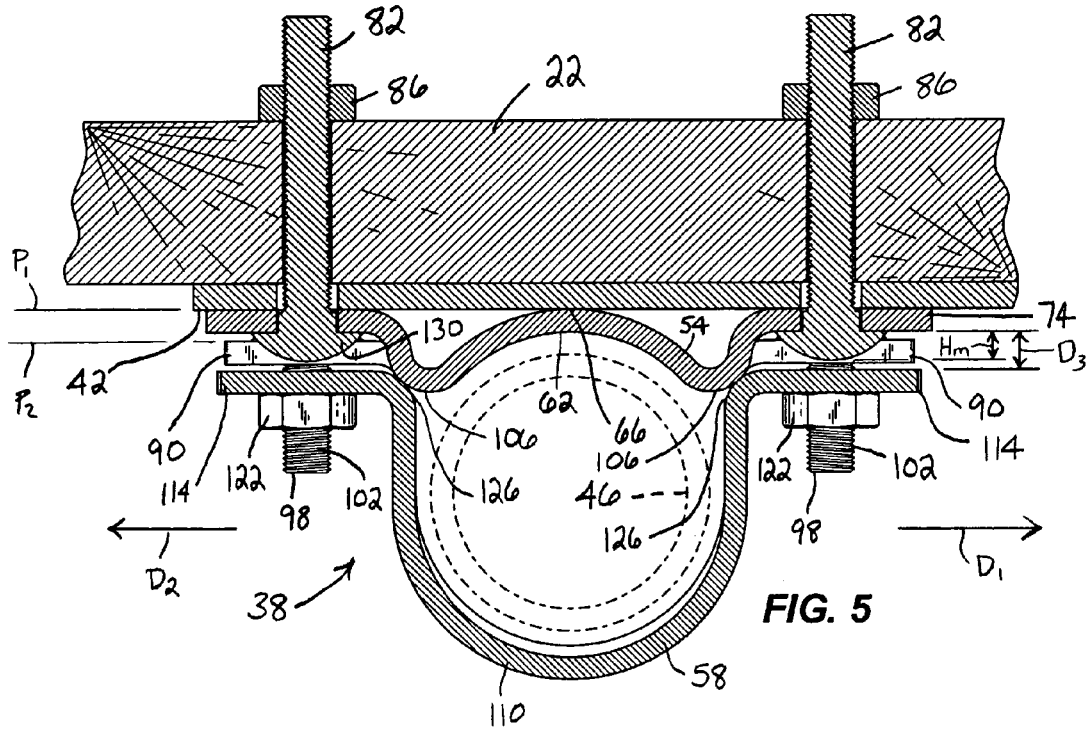
FIG. 5 is a section view taken along line 5—5 of FIG. 4.
Figure 6:
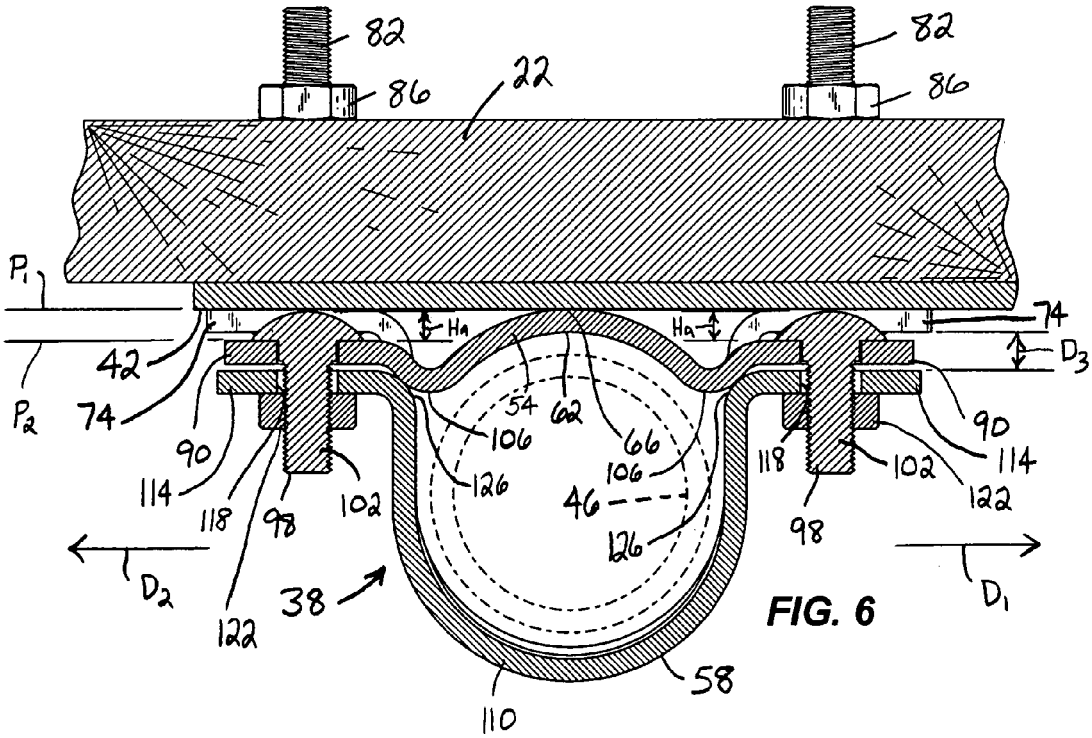
FIG. 6 is a section view taken along line 6—6 of FIG. 4.

FIGS. 2–6 illustrate the pipe sleeve assembly 38 in greater detail. The pipe sleeve assembly 38 includes a base plate 54 and a sleeve portion 58 configured to be removably coupled to the base plate 54 for slidably supporting the pipe 46 in the pipe sleeve assembly 38. As best shown in FIGS. 3, 5, and 6, the base plate 54 includes a base portion 62 configured to receive the pipe 46. In the illustrated embodiment, the base portion 62 is arcuately-shaped to facilitate slidably receiving the pipe 46. A central portion 66 of the base portion 62 engages the mounting surface 42 when the base plate 54 is mounted to the frame 22. The base portion defines a longitudinal axis 70 (see FIG. 3) that extends in substantially the same direction as the pipe 46 received in the pipe sleeve assembly 38.

The base plate 54 further includes one or more mounting flanges 74 that extend from the base portion 62. In the illustrated embodiment, there are four mounting flanges 74. Two of the mounting flanges 74 extend from the base portion 62 in a first direction $D_1$ generally normal to the longitudinal axis 70, and two of the mounting flanges 74 extend from the base portion 62 in a second direction $D_2$ generally normal to the longitudinal axis 70 and substantially opposite to the first direction $D_1$.

As best illustrated in FIGS. 5 and 6, the mounting flanges 74 all lie in a first plane $P_1$ that is generally co-planar with the mounting surface 42. When the base plate 54 is mounted to the mounting surface 42, the rear surfaces of the mounting flanges 74 abut the mounting surface 42. Each mounting flange 74 includes an aperture 78 (see FIG. 3) for receiving a respective mounting fastener 82 configured to secure the base plate 54 to the mounting surface 42 and the frame 22. In the illustrated embodiment, the mounting fasteners 82 are ⅜"–16×3" carriage bolts, however, any suitable fasteners can be used. The fasteners 82 are inserted through the apertures 78 in the flanges 74 and into the plate defining the mounting surface 42 and the remainder of the frame 22. The fasteners 82 are secured to the frame 22 via locking nuts 86 or other suitable mechanisms to secure the base plate 54 to the mounting surface 42 and the frame 22.

The base plate 54 further includes one or more assembly flanges 90 that extend from the base portion 62. In the illustrated embodiment, there are two assembly flanges 90. One of the assembly flanges 90 extends from the base portion 62 in the first direction $D_1$ and is intermediate the two mounting flanges 74 extending in the first direction $D_1$. The other assembly flange 90 extends from the base portion 62 in the second direction $D_2$ and is intermediate the two mounting flanges 74 extending in the second direction $D_2$. In other words, in the illustrated embodiment each assembly flange 90 is spaced in a direction generally parallel to the longitudinal axis 70 from the corresponding two mounting flanges 74 on the same side of the base portion 62.

As best illustrated in FIGS. 5 and 6, the assembly flanges 90 lie in a second plane $P_2$ that is spaced from the first plane $P_1$, and therefore, the second plane $P_2$ is also spaced from the mounting surface 42. Each assembly flange 90 includes an aperture 94 (see FIG. 3) for receiving an assembly fastener 98 configured to secure the sleeve portion 58 to the base plate 54, as will be described in greater detail below. In the illustrated embodiment, the assembly fasteners 98 are ⅜"–16×1" carriage bolts, however, any suitable fasteners can be used. The assembly fasteners 98 are inserted through the apertures 94 such that the stud portion 102 of each fastener 98 extends from the assembly flanges 90 in a direction away from the first plane $P_1$ and the mounting surface 42. Therefore, the assembly fasteners 98 extend in the opposite direction to the mounting fasteners 82.

As illustrated in FIG. 6, when the base plate 54 is mounted to the mounting surface 42, the heads 104 (see FIG. 3) of the assembly fasteners 98 are retained between the mounting surface 42 and the assembly flanges 90 as shown in FIG. 6 so that the assembly fasteners 98 cannot fall out of the base plate 54. This facilitates assembling and dis-assembling the pipe sleeve assemblies 38 by eliminating the possibility of accidentally dropping the assembly fasteners 98 into the river or lake. To retain the assembly fasteners 98 in this manner, the base plate 54 is designed such that the first and second planes $P_1$ and $P_2$ are spaced apart by a distance substantially equal to a head height $H_a$ (see FIG. 6) of the assembly fasteners 98.

The illustrated base plate 54 is formed from a single stamped piece of steel, aluminum, or other suitable material. The thickness of the base plate 54 is substantially uniform at all locations on the base plate 54, including the flanges 74, 90, and the base portion 62. No welding is required to create the base plate 54. Spaced transition portions 106 extend between the base portion 62 and the respective flanges 74, 90 and define contact areas for contacting the sleeve portion 58. As illustrated in FIG. 3, the transition portions 106 extend substantially the entire length of the base portion 62. The illustrated base plate has a low profile or small overall thickness in that the distance from the mounting surface 42 to the furthest point away from the mounting surface 42 on the base plate 54 (i.e., the apices of the transition portions 106) is between about 0.5 inches to 1.0 inches. As illustrated, the overall thickness of the base plate 54 is about 0.56 inches.

The sleeve portion 58 includes a body portion 110 configured for receiving the pipe 46. As illustrated, the body portion 110 includes a plurality of ribs 112 that strengthen the body portion 110. The specific configuration and number of ribs 112 can vary as desired.

The sleeve portion 58 further includes one or more sleeve flanges 114 that extend from the body portion 110. In the illustrated embodiment, there are two sleeve flanges 114. One of the sleeve flanges 114 extends from the body portion 110 in the first direction $D_1$ and the other sleeve flange 114 extends from the body portion 110 in the second direction $D_2$. The sleeve flanges 114 overlie respective assembly flanges 90 and each sleeve flange 114 includes an aperture 118 for receiving the respective stud portion 102 of the assembly fasteners 98. Locking nuts 122 or other suitable mechanisms are fastened on the stud portions 102 to secure the sleeve portion 58 to the base plate 54.

The sleeve portion 58 includes transition portions 126 between the body portion 110 and each sleeve flange 114. The transition portions 126 contact the respective transition portions 106 of the base plate 54 when the sleeve portion 58 is assembled to the base plate 54. The illustrated transition portions 126 extend substantially the entire length of the body portion 110. As best illustrated in FIGS. 5 and 6, the base portion 62 and the body portion 110 are sized and configured to form a free-floating fit with the pipe 46 so that the pipe 46 and the pipe sleeve assembly 38 are free to move with respect to one another, thereby allowing the floating dock 10 to move up and down on the pipe 46 with the rising and falling of the water level. It should be noted that the fit between the pipe 46 and the pipe sleeve assembly 38 can vary as desired. Different size pipes 46 can be used within the illustrated pipe sleeve assembly 38, and if needed, sleeve inserts (not shown) could be positioned within the pipe sleeve assembly 38 (or on the pipe 46) to achieve the desired fit between the pipe 46 and the pipe sleeve assembly 38.

In the illustrated embodiment, the sleeve flanges 114 are sized to also overlie at least a portion of the mounting flanges 74 on the corresponding side of the pipe sleeve assembly 38. When assembled, each sleeve flange 114 is spaced from the respective mounting flanges 74 by a distance $D_3$ that is substantially equal to or just slightly larger than a head height $H_m$ (see FIG. 5) of the mounting fasteners 82. This enables the sleeve flanges 114 to also overlie at least a portion of each mounting fastener 82 in the respective mounting flanges 74. It also enables the width of the sleeve portion 58 in a direction substantially perpendicular to the longitudinal axis 70 to be substantially the same as the width of the base plate 54. As shown in FIG. 4, the heads 130 of the mounting fasteners 82 are substantially covered by the sleeve flanges 114 to be substantially hidden from view from the front of the pipe sleeve assembly 38. Therefore, the illustrated assembled pipe sleeve assembly 38 incorporates six total fasteners 82 and 98, but only the two assembly fasteners 98 are exposed and visible from the front of the assembled pipe sleeve assembly 38. These design considerations give the pipe sleeve assembly 38 a "clean" aesthetic look.

The illustrated sleeve portion 58 is also formed from a single stamped piece of steel, aluminum, or other suitable material. The thickness of the sleeve portion 58 is substantially uniform at all locations on the sleeve portion 58 with the possible exception of the ribs 112. No welding is required to create the sleeve portion 58. When the sleeve portion 58 is assembled to the base plate 54, the overall distance the pipe sleeve assembly 38 extends from the mounting surface 42 is less than about 2.5 inches, and as illustrated is about 2.43 inches. This relatively small overall dimension also contributes to the generally low-profile design of the pipe sleeve assembly 38.

While the illustrated pipe sleeve assembly 38 has an overall height in the direction of the longitudinal axis 70 of about five inches, the height can vary as desired. For example, the pipe sleeve assembly 38 could be extended to include another set of oppositely-extending assembly flanges 90 and/or another set of oppositely-extending mounting flanges 74 arranged in a manner similar to the illustrated assembly flanges 90 or mounting flanges 74. The sleeve flanges 114 could also be lengthened as desired to accommodate the additional assembly flanges 90 and/or mounting flanges 74. Changing the overall height of the pipe sleeve assembly 38 will vary the ability of the pipe 46 to move within the pipe sleeve assembly 38. Increasing the height of the pipe sleeve assembly will constrain the relative movement to a more vertical direction (as illustrated in FIGS. 2 and 4) by not allowing as much lateral movement of the pipe 46 within the pipe sleeve assembly 38.

The design of the pipe sleeve assembly 38 facilitates assembly, installation, and removal of the floating dock 10. First, the base plate 54 is positioned on the mounting surface 42 with the assembly fasteners 98 extending through the apertures 94 in the assembly flanges 90. The mounting fasteners 82 are then secured as described above to secure the base plate 54 to the frame 22. Once the base plate 54 is secured to the mounting surface 42, the heads 104 of the assembly fasteners 98 are constrained between the mounting surface 42 and the assembly flanges 90 so that the fasteners 98 cannot fall out of the base plate 54.

The installer, can then position the pipe 46 (with the auger portion 50 already attached to the pipe 46) against the base portion 62 and couple the sleeve portion 58 to the base plate 54 as described above. To remove the pipe 46 from the pipe sleeve assembly 38, the installer needs only remove the sleeve portion 58 from the base plate 54. No cumbersome vertical-direction manipulation of the pipe 46 is required. Additionally, the auger portion 50 need not be repeatedly removed from and installed on the pipe 46.

Various features of the invention are set forth in the following claims.

The invention claimed is:

1. A pipe sleeve assembly comprising:

a base plate including;

a base portion defining a longitudinal axis and configured for receiving a pipe;

a first flange extending from the base portion in a first direction generally normal to the longitudinal axis and lying in a first plane, the first flange including an aperture for receiving a first fastener configured to secure the base plate to a mounting surface; and a second flange extending from the base portion in the first direction, spaced from the first flange in a second direction generally parallel to the longitudinal axis, and lying in a second plane spaced from the first plane;

a sleeve portion including;

a body portion configured for receiving the pipe; and a third flange extending from the body portion in the first direction, the third flange overlying at least a portion of the second flange and including an aperture; and a second fastener extending from the second flange and received in the aperture in the third flange to secure the sleeve portion to the base plate, the second fastener including a head positioned between the first plane and the second plane;

wherein the head of the second fastener has a head height, and wherein the first and second planes are spaced apart by a distance substantially equal to the head height of the second fastener.

2. A pipe sleeve assembly comprising:

a base plate including;

a base portion defining a longitudinal axis and configured for receiving a pipe;

a first flange extending from the base portion in a first direction generally normal to the longitudinal axis and lying in a first plane, the first flange including an aperture for receiving a first fastener configured to secure the base plate to a mounting surface; and a second flange extending from the base portion in the first direction, spaced from the first flange in a second direction generally parallel to the longitudinal axis, and lying in a second plane spaced from the first plane;

a sleeve portion including;

a body portion configured for receiving the pipe; and a third flange extending from the body portion in the first direction, the third flange overlying at least a portion of the second flange and including an aperture; and a fastener stud extending from the second flange and received in the aperture in the third flange to secure the sleeve portion to the base plate, wherein the third flange also overlies at least a portion of the first flange and at least a portion of the first fastener.

3. The pipe sleeve assembly of claim 2, wherein the first fastener includes a head having a head height, and wherein the third flange is spaced from the first flange by a distance substantially equal to the head height of the first fastener.

4. The pipe sleeve assembly of claim 1, wherein the base plate further includes a transition portion between the base portion and at least one of the first and second flanges, wherein the sleeve portion includes a transition portion between the body portion and the third flange, and wherein the transition portion of the base plate and the transition portion of the sleeve portion engage one another when the sleeve portion is secured to the base plate.

5. The pipe sleeve assembly of claim 4, wherein the transition portion of the base plate extends substantially an entire length of the base portion and the transition portion of the sleeve portion extends substantially an entire length of the body portion.

6. The pipe sleeve assembly of claim 1, wherein the base plate further includes a fourth flange extending from the base portion in the first direction and lying in the first plane, the fourth flange including an aperture for receiving a third fastener configured to secure the base plate to the mounting surface, and wherein the second flange is intermediate the first and fourth flanges in the direction of the longitudinal axis.

7. The pipe sleeve assembly of claim 6, wherein the third flange also overlies at least a portion of the fourth flange and at least a portion of the third fastener.

8. The pipe sleeve assembly of claim 1, further comprising:

a fourth flange extending from the base portion of the base plate in a second direction generally normal to the longitudinal axis and lying in the first plane, the fourth flange including an aperture for receiving a third fastener configured to secure the base plate to the mounting surface;

a fifth flange extending from the base portion in the second direction, spaced from the fourth flange in a second direction generally parallel to the longitudinal axis, and lying in the second plane;

a sixth flange extending from the body portion of the sleeve portion in the second direction, the sixth flange overlying at least a portion of the fifth flange and including an aperture; and a fastener stud extending from the fifth flange and received in the aperture in the sixth flange to secure the sleeve portion to the base plate.

9. The pipe sleeve assembly of claim 8, wherein the sixth flange also overlies at least a portion of the fourth flange and at least a portion of the third fastener.

10. The pipe sleeve assembly of claim 9, wherein the third fastener includes a head having a head height, and wherein the sixth flange is spaced from the fourth flange by a distance substantially equal to the head height of the third fastener.

11. The pipe sleeve assembly of claim 8, wherein the fastener stud extending from the fifth flange is part of a fourth fastener extending through an aperture in the fifth flange, wherein the fourth fastener includes a head having a head height, and wherein the first and second planes are spaced apart by a distance substantially equal to the head height of the fourth fastener.

12. A floating dock assembly comprising:

a frame;

at least one float coupled to the frame;

a sleeve assembly coupled to a mounting surface of the frame; and a support member slidably received in the sleeve assembly such that the support member can move relative to the sleeve assembly;

the sleeve assembly including;

a base plate having, a base portion defining a longitudinal axis and receiving the support member;

a first flange extending from the base portion in a first direction generally normal to the longitudinal axis and abutting the mounting surface, the first flange including an aperture for receiving a first fastener securing the base plate to the mounting surface; and a second flange extending from the base portion in the first direction, spaced from the first flange in a second direction generally parallel to the longitudinal axis, and spaced from the mounting surface;

a removable sleeve portion including, a body portion receiving the support member; and a third flange extending from the body portion in the first direction, the third flange overlying at least a portion of the second flange; and a second fastener coupled with the second and third flanges to secure the sleeve portion to the base plate, the second fastener having a head positioned between the second flange and the mounting surfaces;

wherein the head of the second fastener has a head height, and wherein the second flange is spaced from the mounting surface by a distance substantially equal to the head height of the second fastener to retain the head of the second fastener between the second flange and the mounting surface.

13. A floating dock assembly comprising:

a frame;

at least one float coupled to the frame;

a sleeve assembly coupled to a mounting surface of the frame; and a support member slidably received in the sleeve assembly such that the support member can move relative to the sleeve assembly;

the sleeve assembly including;

a base plate having, a base portion defining a longitudinal axis and receiving the support member;

a first flange extending from the base portion in a first direction generally normal to the longitudinal axis and abutting the mounting surface, the first flange including an aperture for receiving a first fastener securing the base plate to the mounting surface; and a second flange extending from the base portion in the first direction, spaced from the first flange in a second direction generally parallel to the longitudinal axis, and spaced from the mounting surface;

a removable sleeve portion including, a body portion receiving the support member; and a third flange extending from the body portion in the first direction, the third flange overlying at least a portion of the second flange; and a second fastener coupled with the second and third flanges to secure the sleeve portion to the base plate, wherein the third flange also overlies at least a portion of the first flange and at least a portion of the first fastener.

14. The floating dock assembly of claim 13, wherein the first fastener includes a head having a head height, and wherein the third flange is spaced from the first flange by a distance substantially equal to the head height of the first fastener, providing clearance between the first flange and the third flange for housing the head of the first fastener.

15. The floating dock assembly of claim 12, wherein the second fastener includes a stud portion extending from the second flange and away from the mounting surface.

16. The floating dock assembly of claim 12, wherein the base plate further includes a fourth flange extending from the base portion in the first direction and abutting the mounting surface, the fourth flange including an aperture for receiving a third fastener securing the base plate to the mounting surface, and wherein the second flange is intermediate the first and fourth flanges in the direction of the longitudinal axis.

17. The floating dock assembly of claim 16, wherein the third flange also overlies at least a portion of the fourth flange and at least a portion of the third fastener.

18. The floating dock assembly of claim 12, wherein the sleeve assembly further includes;

a fourth flange extending from the base portion of the base plate in a second direction generally normal to the longitudinal axis and abutting the mounting surface, the fourth flange including an aperture for receiving a third fastener configured to secure the base plate to the mounting surface;

a fifth flange extending from the base portion in the second direction, spaced from the fourth flange in a second direction generally parallel to the longitudinal axis, and spaced from the mounting surface;

a sixth flange extending from the body portion of the sleeve portion in the second direction, the sixth flange overlying at least a portion of the fifth flange; and a fourth fastener coupled with the fifth and sixth flanges to secure the sleeve portion to the base plate.

19. The floating dock assembly of claim 18, wherein the sixth flange also overlies at least a portion of the fourth flange and at least a portion of the third fastener.

20. The floating dock assembly of claim 19, wherein the third fastener includes a head having a head height, and wherein the sixth flange is spaced from the fourth flange by a distance substantially equal to the head height of the third fastener, providing clearance between the fourth flange and the sixth flange for housing the head of the third fastener.

21. The floating dock assembly of claim 18, wherein the fourth fastener includes a head having a head height, and wherein the fifth flange is spaced from the mounting surface by a distance substantially equal to the head height of the fourth fastener to retain the head of the fourth fastener between the fifth flange and the mounting surface.

22. The floating dock assembly of claim 18, wherein the fourth fastener includes a stud portion extending from the fifth flange and away from the mounting surface.

23. A pipe sleeve assembly comprising:

a base plate including;

a base portion defining a longitudinal axis and configured for receiving a pipe;

a first flange extending from the base portion in a first direction generally normal to the longitudinal axis and lying in a first plane, the first flange including an aperture for receiving a first fastener configured to secure the base plate to a mounting surface; and a second flange extending from the base portion in the first direction, spaced from the first flange in a second direction generally parallel to the longitudinal axis, and lying in a second plane spaced from the first plane;

a sleeve portion including;

a body portion configured for receiving the pipe; and a third flange extending from the body portion in the first direction, the third flange overlying at least a portion of the second flange and including an aperture; and a second fastener extending from the second flange and received in the aperture in the third flange to secure the sleeve portion to the base plate;

wherein the base plate further includes a fourth flange extending from the base portion in the first direction and lying in the first plane, the fourth flange including an aperture for receiving a third fastener configured to secure the base plate to the mounting surface, and wherein the second flange is intermediate the first and fourth flanges in the direction of the longitudinal axis.

24. The pipe sleeve assembly of claim 23, wherein the third flange also overlies at least a portion of the fourth flange and at least a portion of the third fastener.

25. The pipe sleeve assembly of claim 23:

wherein at least one of the base plate and the sleeve portion is a one-piece stamped component.

26. The pipe sleeve assembly of claim 25, wherein each of the base plate and the sleeve portion is a one-piece stamped component.

27. A floating dock assembly comprising:

a frame;

at least one float coupled to the frame;

a sleeve assembly coupled to a mounting surface of the frame; and a support member slidably received in the sleeve assembly such that the support member can move relative to the sleeve assembly;

the sleeve assembly including;

a base plate having, a base portion defining a longitudinal axis and receiving the support member;

a first flange extending from the base portion in a first direction generally normal to the longitudinal axis and abutting the mounting surface, the first flange including an aperture for receiving a first fastener securing the base plate to the mounting surface; and a second flange extending from the base portion in the first direction, spaced from the first flange in a second direction generally parallel to the longitudinal axis, and spaced from the mounting surface;

a removable sleeve portion including, a body portion receiving the support member; and a third flange extending from the body portion in the first direction, the third flange overlying at least a portion of the second flange; and a second fastener coupled with the second and third flanges to secure the sleeve portion to the base plate;.

wherein the base plate further includes a fourth flange extending from the base portion in the first direction and abutting the mounting surface, the fourth flange including an aperture for receiving a third fastener securing the base plate to the mounting surface, and wherein the second flange is intermediate the first and fourth flanges in the direction of the longitudinal axis.

28. The floating dock assembly of claim 27:

wherein at least one of the base plate and the sleeve portion is a one-piece stamped component.

29. The floating dock assembly of claim 28, wherein each of the base plate and the sleeve portion is a one-piece stamped component.

30. The floating dock assembly of claim 27, wherein the third flange also overlies at least a portion of the fourth flange and at least a portion of the third fastener.

31. The pipe sleeve assembly of claim 2, wherein the base plate further includes a fourth flange extending from the base portion in the first direction and lying in the first plane, the fourth flange including an aperture for receiving a third fastener configured to secure the base plate to the mounting surface, and wherein the second flange is intermediate the first and fourth flanges in the direction of the longitudinal axis.

32. The pipe sleeve assembly of claim 31, wherein the third flange also overlies at least a portion of the fourth flange and at least a portion of the third fastener.

33. The floating dock assembly of claim 13, wherein the base plate further includes a fourth flange extending from the base portion in the first direction and abutting the mounting surface, the fourth flange including an aperture for receiving a third fastener securing the base plate to the mounting surface, and wherein the second flange is intermediate the first and fourth flanges in the direction of the longitudinal axis.

34. The floating dock assembly of claim 33, wherein the third flange also overlies at least a portion of the fourth flange and at least a portion of the third fastener.

35. The pipe sleeve assembly of claim 1, wherein the third flange also overlies at least a portion of the first flange and at least a portion of the first fastener.

36. The pipe sleeve assembly of claim 35, wherein the first fastener includes a head having a head height, and wherein the third flange is spaced from the first flange by a distance substantially equal to the head height of the first fastener.

37. The pipe sleeve assembly of claim 35, wherein the base plate further includes a fourth flange extending from the base portion in the first direction and lying in the first plane, the fourth flange including an aperture for receiving a third fastener configured to secure the base plate to the mounting surface, and wherein the second flange is intermediate the first and fourth flanges in the direction of the longitudinal axis.

38. The floating dock assembly of claim 12, wherein the third flange also overlies at least a portion of the first flange and at least a portion of the first fastener.

39. The floating dock assembly of claim 38, wherein the first fastener includes a head having a head height, and wherein the third flange is spaced from the first flange by a distance substantially equal to the head height of the first fastener, providing clearance between the first flange and the third flange for housing the head of the first fastener.

40. The floating dock assembly of claim 38, wherein the base plate further includes a fourth flange extending from the base portion in the first direction and abutting the mounting surface, the fourth flange including an aperture for receiving a third fastener securing the base plate to the mounting surface, and wherein the second flange is intermediate the first and fourth flanges in the direction of the longitudinal axis.

* * * * *